US011667137B2

(12) United States Patent
Kanemaru et al.

(10) Patent No.: US 11,667,137 B2
(45) Date of Patent: Jun. 6, 2023

(54) MEDIUM TRANSPORT APPARATUS AND PROCESSING APPARATUS

(71) Applicant: SEIKO EPSON CORPORATION, Tokyo (JP)

(72) Inventors: Shinji Kanemaru, Matsumoto (JP); Daiki Takahashi, Ueda (JP); Keisuke Sasaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 108 days.

(21) Appl. No.: 17/105,312

(22) Filed: Nov. 25, 2020

(65) Prior Publication Data

US 2021/0155019 A1 May 27, 2021

(30) Foreign Application Priority Data

Nov. 27, 2019 (JP) ..... JP2019-214129

(51) Int. Cl.
*B41J 11/00* (2006.01)
*B41J 13/00* (2006.01)
*B65H 5/06* (2006.01)

(52) U.S. Cl.
CPC ..... *B41J 13/0009* (2013.01); *B65H 5/062* (2013.01)

(58) Field of Classification Search
CPC ..... B41J 13/009; B41J 11/007
See application file for complete search history.

(56) References Cited

U.S. PATENT DOCUMENTS

2019/0092048 A1* 3/2019 Otsuka ..... B41J 13/009

FOREIGN PATENT DOCUMENTS

JP H10001240 A 1/1998
JP 2009226590 A 10/2009

* cited by examiner

*Primary Examiner* — Lam S Nguyen
(74) *Attorney, Agent, or Firm* — Chip Law Group

(57) ABSTRACT

A medium transport apparatus includes a body portion, an inversion unit, and an extension unit. The body portion has a second manual feed path for a sheet material. The inversion unit is configured to be mounted on and separated from the body portion, covers the second manual feed path when the attachment/detachment portion is mounted the body portion, and exposes a portion of the second manual feed path when the attachment/detachment portion is separated from the body portion. The extension unit is configured to be attached to and detached from the attachment/detachment portion. The extension unit extends, in a state in which the inversion unit is separated, the second manual feed path in a transport direction of the sheet material by being detached from the inversion unit and attached to the body portion.

9 Claims, 14 Drawing Sheets

MEDIUM TRANSPORT APPARATUS AND PROCESSING APPARATUS

The present application is based on, and claims priority from JP Application Serial Number 2019-214129, filed Nov. 27, 2019, the disclosure of which is hereby incorporated by reference herein in its entirety.

BACKGROUND

1. Technical Field

The present disclosure relates to a medium transport apparatus that transports a medium, and a processing apparatus that performs processing on a transported medium.

2. Related Art

To date, there is a known configuration in which a rear panel is opened for the purpose of clearing a paper jam or the like, and an example thereof is disclosed in JP-A-10-1240.

In the printing apparatus described in JP-A-10-1240, paper guides are integrated with the rear panel.

There is a medium transport apparatus in which an attachment/detachment portion is configured to be attached to and detached from a portion of an apparatus body that has a transport path for a medium. In this apparatus, the medium can be fed into the transport path by separating the attachment/detachment portion from the apparatus body and exposing the transport path. However, since the transport path for feeding the medium becomes shortened as a result of removing the portion to which the attachment/detachment portion is attached, a path extension member for extending the transport path is required.

However, in a configuration in which the path extension member is stored outside the medium transport apparatus in order to suppress an increase in the size of the apparatus body, the user has to search for the path extension member, which may complicate the user's work. In addition, in a configuration in which a storage portion dedicated to the path extension member is attached to the apparatus body, the apparatus body may be increased in size.

SUMMARY

According to an aspect of the present disclosure, a medium transport apparatus includes an apparatus body having a transport path for a medium, an attachment/detachment portion that is configured to be mounted on the apparatus body and at least a portion of which is configured to be separated from the apparatus body, that covers the transport path when the attachment/detachment portion is mounted on the apparatus body, and that exposes a portion of the transport path when at least the portion of the attachment/detachment portion is separated from the apparatus body, and a path extension member configured to be attached to and detached from the attachment/detachment portion, in which the path extension member extends, in a state in which the attachment/detachment portion is separated, the transport path in a transport direction of the medium by being detached from the attachment/detachment portion and attached to the apparatus body.

DESCRIPTION OF EXEMPLARY EMBODIMENTS

Figure 1:
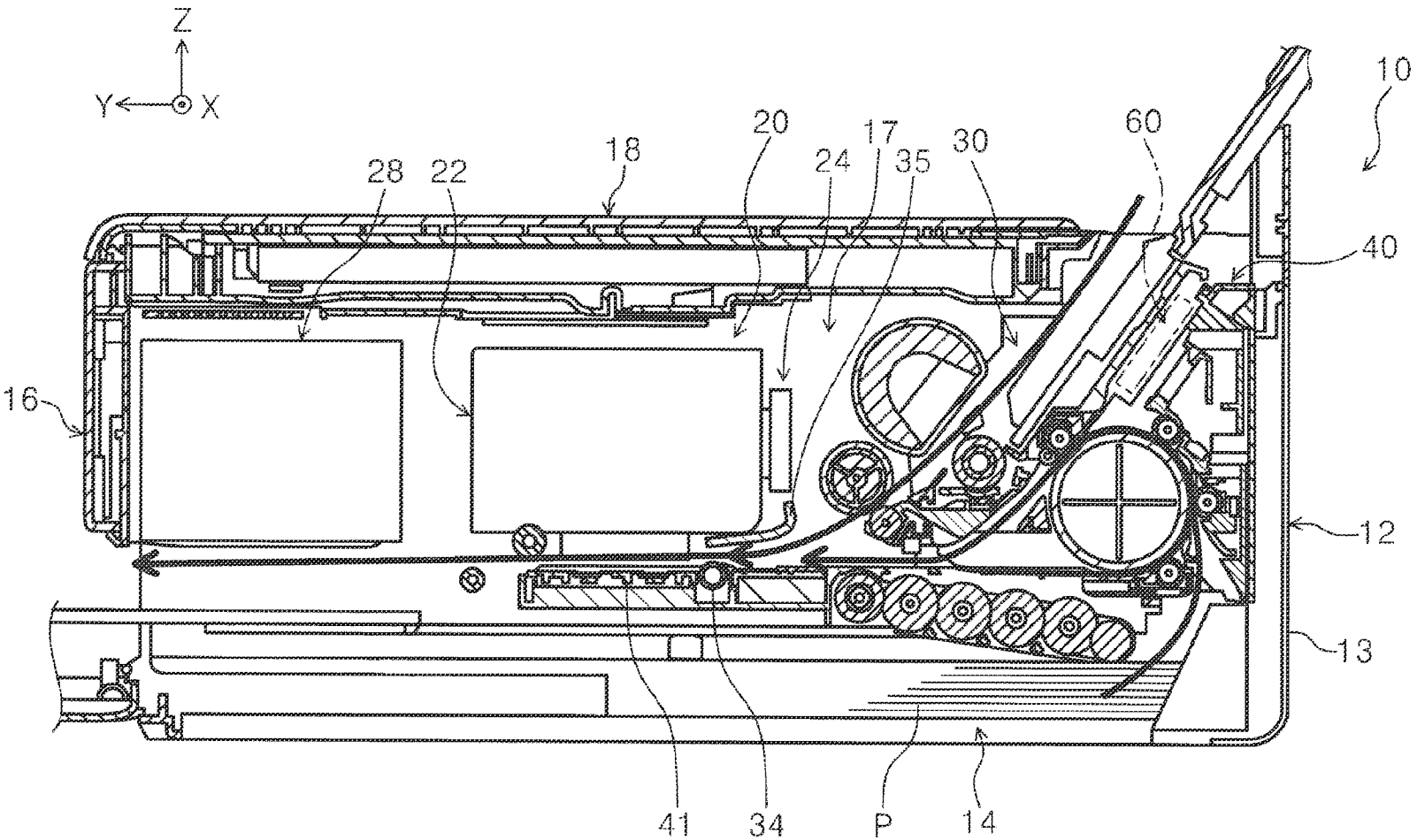
FIG. 1 is a side sectional view illustrating an overall configuration of a printer according to an embodiment.

Hereinafter, the present disclosure will be schematically described.

According to a first aspect of the present disclosure, a medium transport apparatus includes an apparatus body having a transport path for a medium, an attachment/detachment portion that is configured to be mounted on the apparatus body and at least a portion of which is configured to be separated from the apparatus body, that covers the transport path when the attachment/detachment portion is mounted on the apparatus body, and that exposes a portion of the transport path when at least the portion of the attachment/detachment portion is separated from the apparatus body, and a path extension member configured to be attached to and detached from the attachment/detachment portion, in which the path extension member extends, in a state in which the attachment/detachment portion is separated, the transport path in a transport direction of the medium by being detached from the attachment/detachment portion and attached to the apparatus body.

According to this aspect, the attachment/detachment portion is attached to and separated from the apparatus body in a state in which the path extension member is attached to the attachment/detachment portion. Since the path extension member is used as a portion of the attachment/detachment portion that is attached to and separated from the apparatus body, it is not necessary to secure a storage space dedicated to the path extension member in the apparatus body, and it is possible to suppress an increase in the size of the apparatus body.

Furthermore, the path extension member is detached from the attachment/detachment portion in a state in which the attachment/detachment portion is separated from the apparatus body. The path extension member that has been detached from the attachment/detachment portion is attached to the apparatus body to extend the transport path in the medium transport direction. As described above, since the path extension member is attached to the attachment/detachment portion, it is possible to save the user trouble of searching for the path extension member, and the user can easily attach the path extension member to the apparatus body.

That is, according to this aspect, in the configuration in which the attachment/detachment portion is attached to and separated from the apparatus body having the transport path, it is possible to improve the workability of the user in the extension of the transport path and suppress an increase in the size of the apparatus body.

In the medium transport apparatus of a second aspect according to the first aspect, the attachment/detachment portion is an inversion portion that inverts the medium between a front surface and a back surface.

According to this aspect, since the inversion portion, which has a longer path length than that in the case of transporting only the front surface or the back surface, is attachable to and detachable from the apparatus body, when the transport of the medium is stopped in the inversion portion, the medium can be easily removed from the transport path.

In the medium transport apparatus of a third aspect according to the second aspect, a portion of an inverting path formed by the inversion portion being mounted on the apparatus body also serves as a portion of the transport path.

According to this aspect, since a portion of the inverting path also serves as a portion of the transport path, the space required for disposing the transport path and the inverting path is reduced as compared with a configuration in which they are separately present. Thus, it is possible to reduce the size of the medium transport apparatus.

In the medium transport apparatus of a fourth aspect according to any one of the first to third aspects, a engaged portion is formed on the apparatus body, and the path extension member has an engagement portion that engages with the engaged portion while the engagement portion is being elastically deformed.

According to this aspect, when attaching the path extension member to the apparatus body, by pressing the engagement portion toward the engaged portion, the engagement portion is elastically deformed and engages with the engaged portion. In this way, since the work of attaching the path extension member can be easily performed by pressing the path extension member in one direction, the path extension member can be attached to the apparatus body.

In the medium transport apparatus of a fifth aspect according to any one of the first to fourth aspects, the path extension member has a guide portion that guides, in the transport direction, an end portion of the medium in a width direction intersecting the transport direction.

According to this aspect, when the medium is transported in the transport path extended by the path extension member, the medium is guided in the guide direction by the guide portions against which the end portions in the width direction abut. As a result, it is possible to prevent the medium that enters the transport path from the path extension member from skewing.

In the medium transport apparatus of a sixth aspect according to any one of the first to fifth aspects, the attachment/detachment portion has a pedestal portion in which an inclined surface is formed so as to extend in an intersecting direction that intersects a mounting direction toward the apparatus body, and the path extension member is configured to be attached, in contact with the inclined surface, to the pedestal portion and to be detached from the pedestal portion.

According to this aspect, when the attachment/detachment portion is attached to the apparatus body, an external force acts on the attachment/detachment portion in the attachment direction. Here, when the path extension member is pressed in the mounting direction by the external force, since the path extension member is in contact with the inclined surface and is disposed so as to be inclined, the external force in the mounting direction is less likely to be concentrated on a portion of the path extension member as compared with a configuration in which the path extension member is upright. As a result, it is possible to suppress the deformation of the path extension member.

According to a seventh aspect of the present disclosure, a processing apparatus includes the medium transport apparatus according to any one of the first to sixth aspects, and a processing portion that performs processing on the medium being transported on the transport path.

According to this aspect, it is possible to obtain the same effects as those of the medium transport apparatus according to any one of the first to sixth aspects.

In an eighth aspect according to the seventh aspect, the processing apparatus further includes a mobile portion that moves the processing portion in an intersecting direction that intersects the transport direction; a detection portion that detects separation of the attachment/detachment portion from the apparatus body; and a control portion that controls, when the detection portion detects separation of the attachment/detachment portion, the mobile portion to move the processing portion to a side where the processing portion is retracted from the transport path.

According to this aspect, when the attachment/detachment portion is separated from the apparatus body, the detection portion detects the detachment. In this case, the control portion performs control to move the mobile portion to a side where the processing portion is retracted from the transport path. As a result, the processing portion retracts from the transport path. In this way, since the distance between the processing portion and the transport path becomes longer in accordance with the separation of the attachment/detachment portion, a relatively thick medium can be transported in the transport path, and the medium can be processed by the processing portion.

In the processing apparatus of a ninth aspect according to the seventh or eighth aspect, the processing portion is a recording portion that records information on the medium based on received information.

According to this aspect, it is possible to obtain the same effects as those of the processing apparatus according to the seventh aspect or the eighth aspect.

An embodiment of a medium transport apparatus and a processing apparatus according to the present disclosure will be described in detail below with reference to the accompanying drawings. In an XYZ coordinate system illustrated in each drawing, in a printer 10 described later, the X-axis direction is an apparatus width direction, the Y-axis direction is an apparatus depth direction, and the Z-axis direction is an apparatus height direction.

When distinguishing the left side from the right side when viewed from the front in the apparatus width direction, the right side is referred to as the +X side and the left side is referred to as the −X side. When distinguishing the front side from the rear side in the apparatus depth direction, the front side is referred to as the +Y side and the rear side is referred to as the −Y side. When distinguishing the upper side from the lower side in the apparatus height direction, the upper side is referred to as the +Z side and the lower side is referred to as the −Z side.

Printer Outline

FIG. 1 illustrates the printer 10 as an example of a processing apparatus and as an example of a recording apparatus. The printer 10 records various types of information on a paper sheet P or a sheet material S (lower diagram of FIG. 14) as an example of a medium. Various types of information to be recorded on the paper sheet P includes character information and image information.

The paper sheet P is, for example, plain paper. The sheet material S is, for example, thicker than the paper sheet P, is formed as a resin plate material, and has a recessed portion (not illustrated) formed therein. For example, a digital versatile disc (DVD) on which information is recorded is placed in this recessed portion.

In addition, the printer 10 also includes a body portion 12 and a scanner portion 18 placed on the +Z side of the body portion 12. In the printer 10, the same operational effects as those of a paper sheet transport portion 30 described later can be obtained.

The scanner portion 18 reads information of a document (not illustrated). The information of the read document is sent to a control unit 28 described later.

The body portion 12 is an example of an apparatus body and is configured to include a casing 13 that houses each portion of the printer 10, a housing portion 14 that houses the paper sheet P, an operation panel 16 through which various settings for the printer 10 are performed, and a body frame 17 formed of a plurality of metal plates provided in the casing 13. A plurality of paths, which will be described later, for transporting the paper sheet P or the sheet material S (lower diagram of FIG. 14) are formed inside the casing 13.

Figure 2:
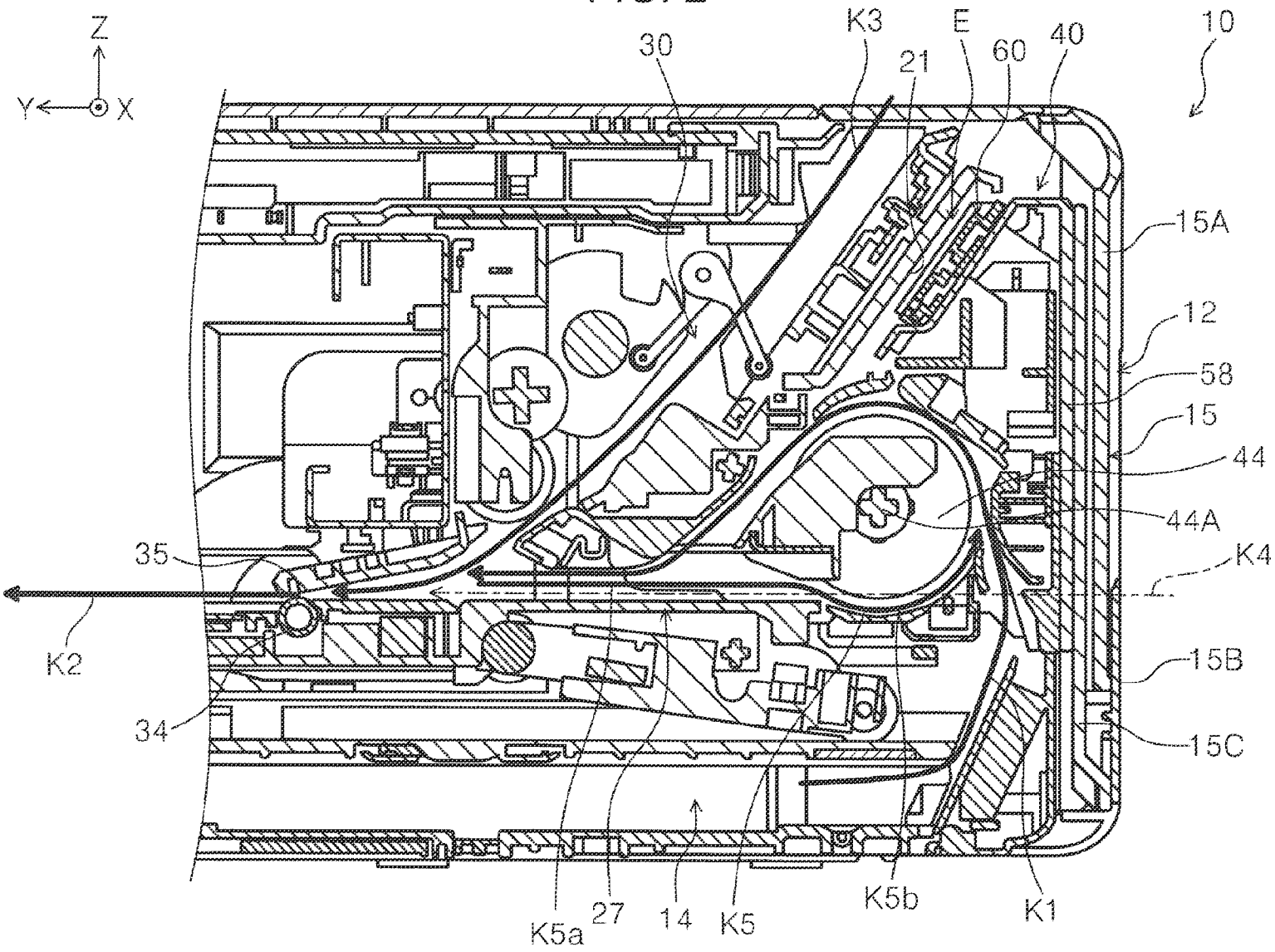
FIG. 2 is a side sectional view illustrating paths along which a sheet is transported in the printer according to the embodiment.

As illustrated in FIG. 2, a medium support portion 15 is provided at a −Y side end portion of the body portion 12. The medium support portion 15 has, for example, support members 15A, 15B, and 15C that are plate-shaped. The support members 15A, 15B, and 15C are stored in the −Y side end portion of the body portion 12 when not in use and form a rear wall portion of the body portion 12 on the −Y side. Further, the medium support portion 15 is disposed on the −Y side of a rear surface cover 58 described later, and covers the rear surface cover 58 from the −Y side.

The support members 15A, 15B, and 15C support the paper sheet P (FIG. 1) that is fed to a first manual feed path K3 described later by being unfolded and tilted to the +Z side when in use.

In addition, as illustrated in FIG. 1, the body portion 12 includes an information recording portion 20 that records information on the paper sheet P or the sheet material S, and the paper sheet transport portion 30 that transports the paper sheet P or the sheet material S toward the information recording portion 20.

Information Recording Portion

The information recording portion 20 illustrated in FIG. 1 records information on the paper sheet P or the sheet material S being transported on a second path K2 and a second manual feed path K4 (FIG. 2) described later based on the received information such as information of the document that has been read by the scanner portion 18 and information input from the outside. Specifically, the information recording portion 20 includes, for example, a head 22, a mobile unit 24, a sensor 26 (FIG. 3), and the control unit 28.

The head 22 is an example of a processing portion and a recording portion, and is configured as a so-called ink-jet recording head that records, as an example of processing, various types of information on the paper sheet P or the sheet material S by ejecting ink, which is an example of a liquid, onto the paper sheet P or the sheet material S. A guide member 41 that forms the bottom surface of the second path K2 (FIG. 2) described later is provided on the −Z side of the head 22. In addition, a transport roller 34 that transports the paper sheet P or the sheet material S toward the head 22 is provided on the −Z side of the head 22. A guide member 35 is provided on the +Z side of the transport roller 34.

Figure 3:
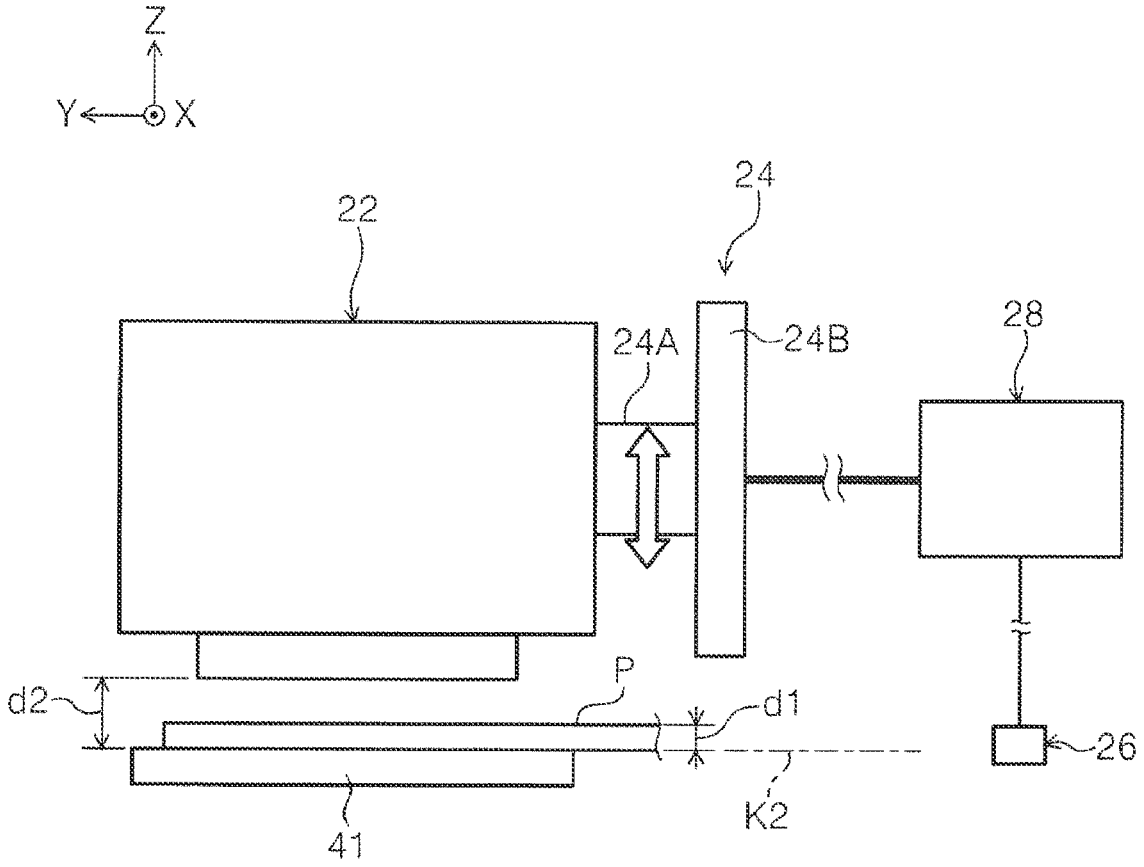
FIG. 3 is a schematic diagram illustrating a state in which a head of the printer according to the embodiment is moved.

The mobile unit 24 illustrated in FIG. 3 is an example of a mobile portion. In addition, the mobile unit 24 has a movable portion 24A that is moved along the Z-axis direction and a base portion 24B that holds the movable portion 24A such that the movable portion 24A is movable. The head 22 is fixed to the movable portion 24A. In addition, the movable portion 24A can be moved to the +Z side or the −Z side of a reference position under the control of the control unit 28 described later. The reference position is set in accordance with the paper sheet P.

In this way, the mobile unit 24 is configured to move the head 22 in the Z-axis direction, which is an example of an intersecting direction that intersects the transport direction of the paper sheet P.

Figure 14:
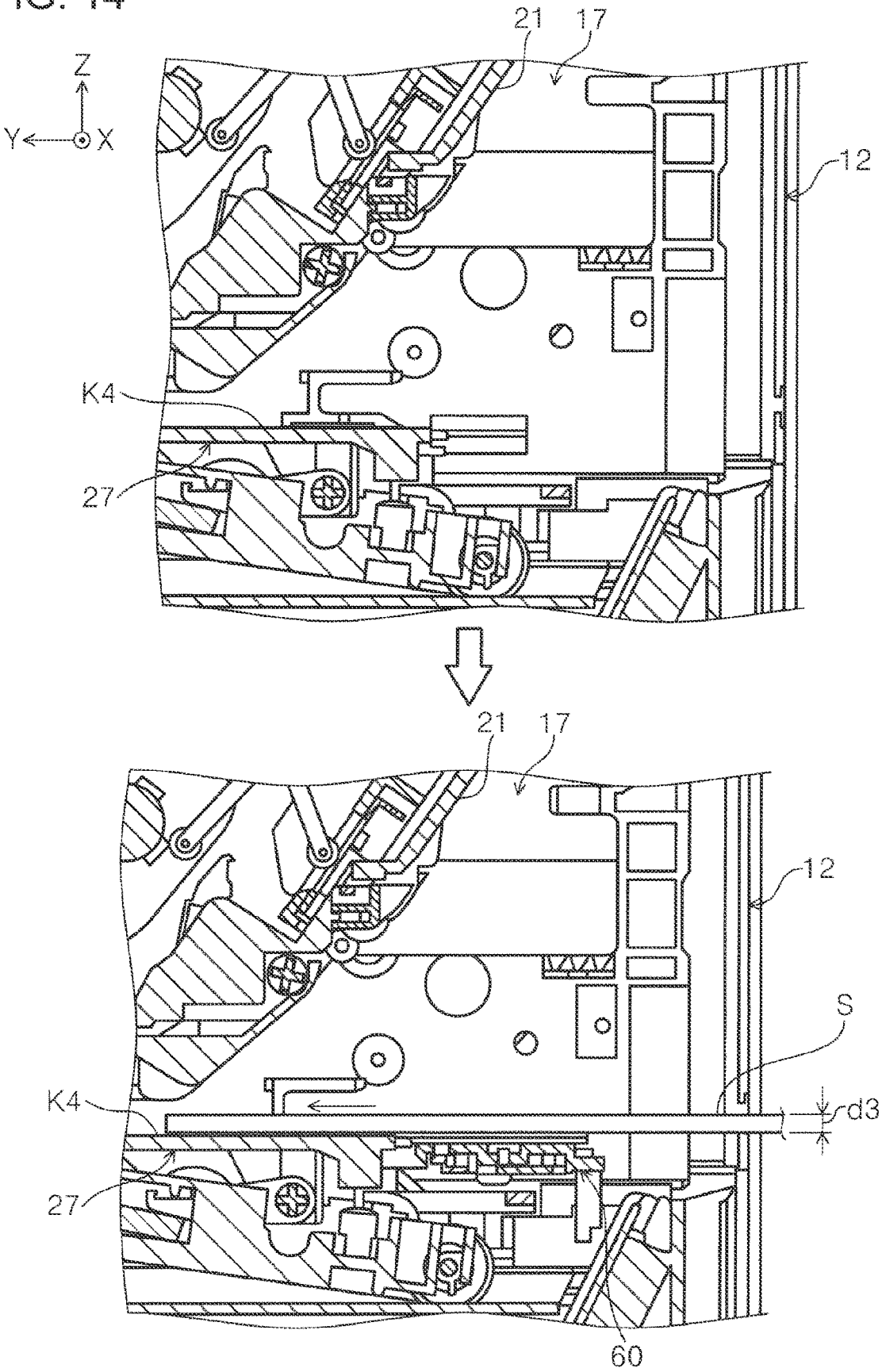
FIG. 14 is a side sectional view illustrating a state in which the extension unit is attached to the portion of the transport path of the printer according to the embodiment.

Assuming that the thickness of the paper sheet P is d1 [mm], and the distance between the −Z side lower surface of the head 22 and the +Z side upper surface of the guide member 41 is d2 [mm]. In addition, assuming that the thickness of the sheet material S, which is thicker than the paper sheet P, is d3 [mm] (FIG. 14). Here, the relationship among the sizes of the thickness d1, the distance d2, and the thickness d3 is d2>d3>d1.

Figure 6:
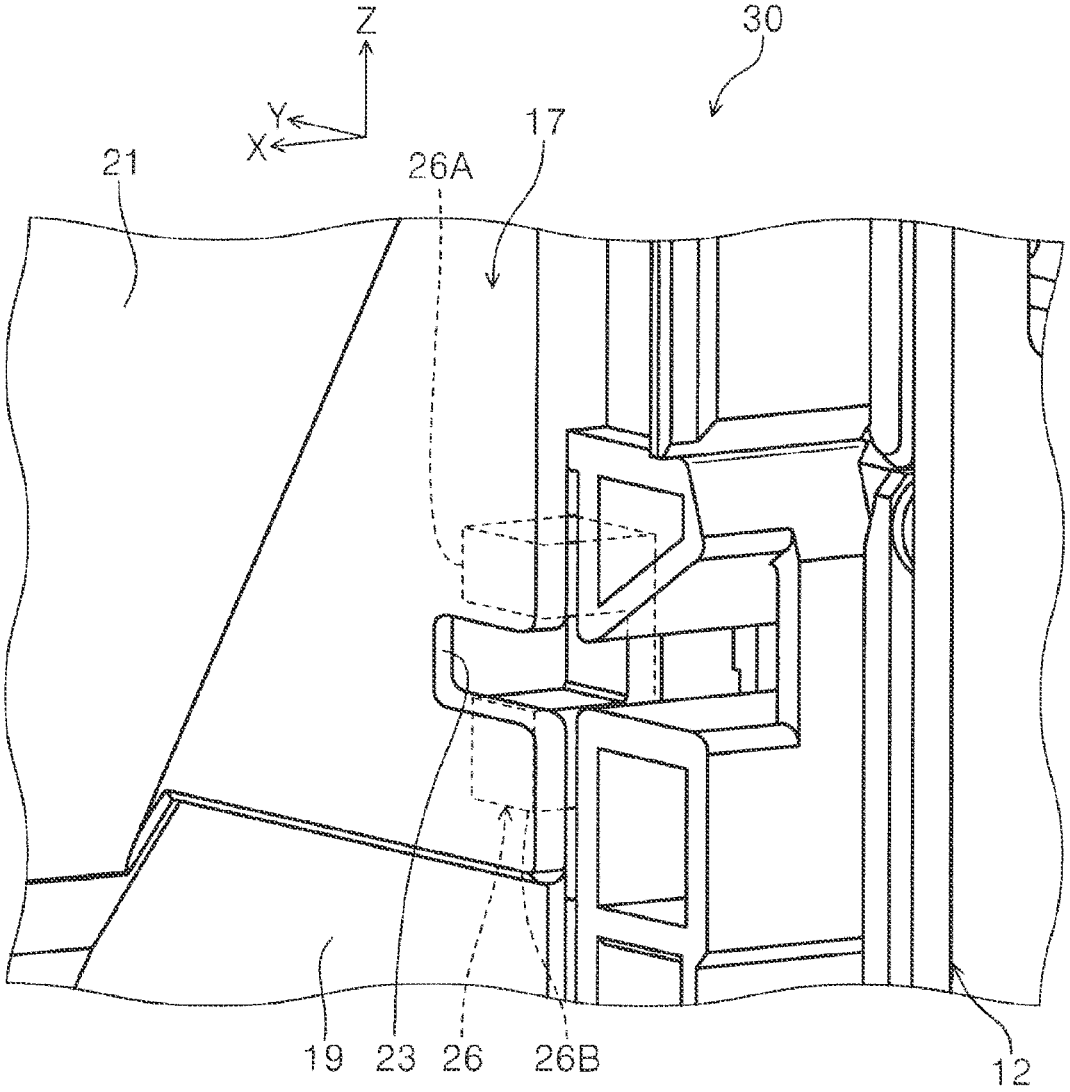
FIG. 6 is a perspective view illustrating an installation state of a sensor in the printer according to the embodiment.

A portion of the body frame 17 illustrated in FIG. 6 is included in the paper sheet transport portion 30 described later. In addition, side walls 19 along the YZ plane are provided on the portion of the body frame 17. The side walls 19 are disposed on the +X side and the −X side of the center of the body portion 12 in the X-axis direction with a space therebetween. An inversion unit 40 (FIG. 1) described later is arranged between a pair of side walls 19. In addition, the side walls 19, when viewed in the X-axis direction, are formed in a triangular shape with the hypotenuse located on the +Y side.

In addition, an inclined wall 21 is provided on a portion of the body frame 17. The inclined wall 21 is inclined so that a +Y side end portion of the inclined wall 21 is located on the −Z side of a −Y side end portion of the inclined wall 21. In addition, the inclined wall 21 couples the hypotenuse portions of the pair of the side walls 19 to each other in the X-axis direction. The inclined wall 21 partitions, in the Y-axis direction, a space portion in which the inversion unit 40 is disposed and a space portion of the first manual feed path K3 (FIG. 2) described later.

A cutout portion 23 that penetrates the side wall 19 in the X-axis direction and that opens toward the −Y side is formed in a portion of the side wall 19. The sensor 26 is provided on the −X side of the cutout portion 23.

The sensor 26 is configured as an optical sensor including an emitting portion 26A that emits light in the Z-axis direction and a light receiving portion 26B that receives the light emitted from the emitting portion 26A. The sensor 26 detects that the inversion unit 40 is attached when the amount of light received by the light receiving portion 26B is smaller than a set amount. In addition, the sensor 26 detects the detachment of the inversion unit 40 from the body portion 12 when the amount of light received by the light receiving portion 26B is equal to or larger than the set amount. Information on whether the inversion unit 40 is attached detected by the sensor 26 is sent to the control unit 28 (FIG. 1).

The control unit 28 illustrated in FIG. 1 includes a central processing unit (CPU), a read only memory (ROM), a random access memory (RAM), and a storage, which are not illustrated. In addition, the control unit 28 is configured not only to control the operation of the head 22 but also to control the transport of the paper sheet P or the sheet material S in the printer 10. In addition, the control unit 28 also controls various operations in the printer 10 based on the information input through the operation panel 16.

Furthermore, when the sensor 26 (FIG. 6) detects the detachment of the inversion unit 40, the control unit 28 controls the mobile unit 24 to move the head 22 to the side (+Z side) where the head 22 is retracted from the second manual feed path K4 (FIG. 2) described later.

Path Through which Paper Sheet is Transported

As illustrated in FIG. 2, the printer 10 includes paths through which the paper sheet P or the sheet material S is transported. Specifically, the body portion 12 has the first path K1, the second path K2, the first manual feed path K3, the second manual feed path K4, and the inverting path K5. Each path is configured to include a plurality of rollers and guide members (not illustrated). Further, the second path K2 and the second manual feed path K4 correspond to an example of a transport path according to the present embodiment.

The paper sheet P can be transported on all the above-mentioned paths.

The sheet material S can be transported only through the second path K2 and the second manual feed path K4.

The first path K1 extends from a −Y side end portion of the housing portion 14 to the +Z side, and extends to the transport roller 34 via the +Z side outer peripheral surface of an inverting roller 44 described later. The portion of the first path K1 from the inverting roller 44 to the transport roller 34 is formed in a straight line along the Y-axis direction. In this linear portion, the paper sheet P or the sheet material S is supported by a lower guide member 27 that forms the lower portion of the path.

The second path K2 extends linearly along the Y-axis direction from the transport roller 34 toward the +Y side via the −Z side of the head 22 (FIG. 1).

The first manual feed path K3 extends obliquely downward to the transport roller 34 from a portion on the −Y side and the +Z side of the center of the body portion 12.

In a state in which the inversion unit 40 described later is detached from the body portion 12, the second manual feed path K4 extends linearly toward the +Y side along the Y-axis direction from a portion on the −Y side of the center of the body portion 12 to the transport roller 34.

The inverting path K5 is formed by the inversion unit 40 being mounted on the body portion 12. In addition, the inverting path K5 has a straight portion K5*a* that extends linearly along the Y-axis direction from the transport roller 34 to the inverting roller 44, and a curved portion K5*b* that joins the first path K1 from the −Y side end of the straight portion K5*a* via the −Z side outer peripheral surface of the inverting roller 44.

In the present embodiment, the straight portion of the first path K1, a portion of the second manual feed path K4, and the straight portion K5*a* are formed as one path. That is, a portion of the inverting path K5 also serves as a portion of the second path K2 and the second manual bypass path K4.

Figure 5:
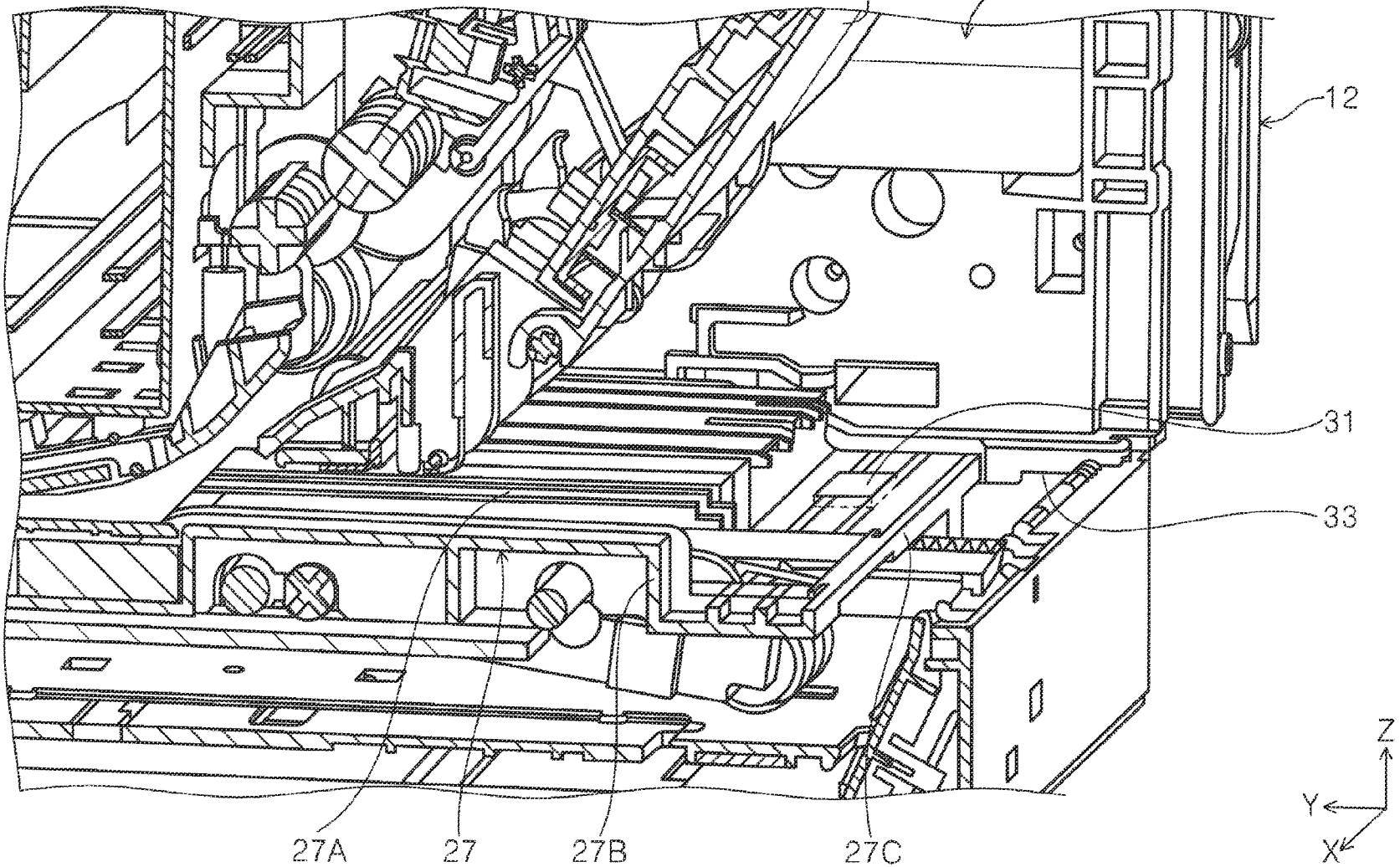
FIG. 5 is a perspective view illustrating a portion of a transport path of the printer according to the embodiment.

FIG. 5 illustrates the lower guide member 27 and a peripheral portion in a state in which the inversion unit 40 (FIG. 1) is detached from the body portion 12. The lower guide member 27 includes an upper wall portion 27A that is plate-shaped and that extends along the XY plane, a longitudinal wall portion 27B extending from a −Y side end portion of the upper wall portion 27A toward the −Z side, and a lower wall portion 27C extending from a −Z side end portion of the longitudinal wall portion 27B toward the −Y side.

A cutout portion 29 (FIG. 13) cut out toward the +Y side is formed in a center portion of the upper wall portion 27A in the X-axis direction and the −Y-side end portion of the upper wall portion 27A in the Y-axis direction.

The height of the longitudinal wall portion 27B in the Z-axis direction is approximately the same as the height of a base portion 62 (FIG. 10) of an extension unit 60 described later. As a result, when the extension unit 60 is placed on the lower wall portion 27C, the height of the upper surface of the upper wall portion 27A on the +Z side and the height of the upper surface of the base portion 62 become substantially the same.

The extension unit 60 is located on the +Z side of the lower wall portion 27C. In addition, a unit detection sensor 31 is provided on a portion of the lower wall portion 27C.

The unit detection sensor 31 is, for example, configured as a reflective optical sensor. In addition, the unit detection sensor 31 includes an emitting portion that emits light and a light receiving portion that receives light. When the extension unit 60 (FIG. 10) is located on the +Z side of the lower wall portion 27C, the unit detection sensor 31 is configured to detect that the extension unit 60 is attached by receiving light reflected by a reflection member (not illustrated) of the extension unit 60 at the light receiving unit. Information on whether the extension unit 60 is attached detected by the unit detection sensor 31 is sent to the control unit 28 (FIG. 1).

engaged portions 33 are formed at positions on the −Z side of the center of the body frame 17 in the Z axis direction and on the −Y side of both end portions of the lower wall portion 27C in the X axis direction.

The engaged portions 33 are portions that are recessed outward in the X-axis direction, and are formed so that a member to be engaged therewith can be inserted in the X-axis direction and engaged in the Z-axis direction.

Paper Sheet Transport Portion

The paper sheet transport portion 30 illustrated in FIG. 2 is an example of a medium transport apparatus, and includes a portion of the body portion 12 described above, the inversion unit 40, and the extension unit 60.

Inversion Unit

Figure 4:
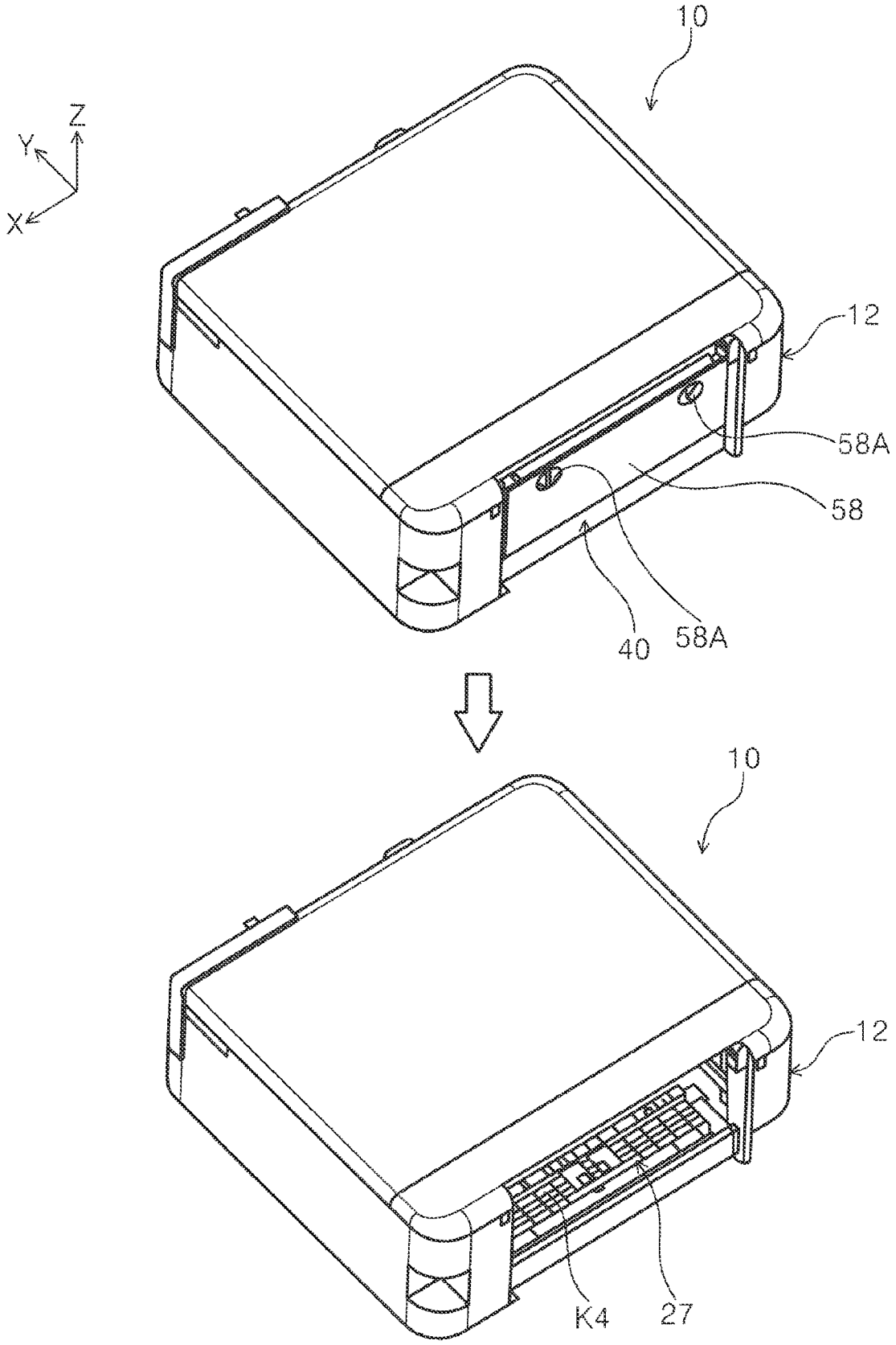
FIG. 4 is a perspective view illustrating a state in which a rear transport path of the printer according to the embodiment is exposed.

The inversion unit 40 illustrated in FIG. 4 is an example of an attachment/detachment portion and an inversion portion, and is provided so as to be attachable to and detachable from the body portion 12. The upper diagram of FIG. 4 illustrates a state in which the inversion unit 40 is attached to the body portion 12 and the second path K2 and the second manual feed path K4 (FIG. 2) are covered. The lower diagram of FIG. 4 illustrates a state in which the inversion unit 40 is detached from the body portion 12 and a portion of the second manual feed path K4 is exposed. In addition, the inversion unit 40 has a function of inverting the front surface and back surface of the paper sheet P or the sheet material S.

Figure 7:
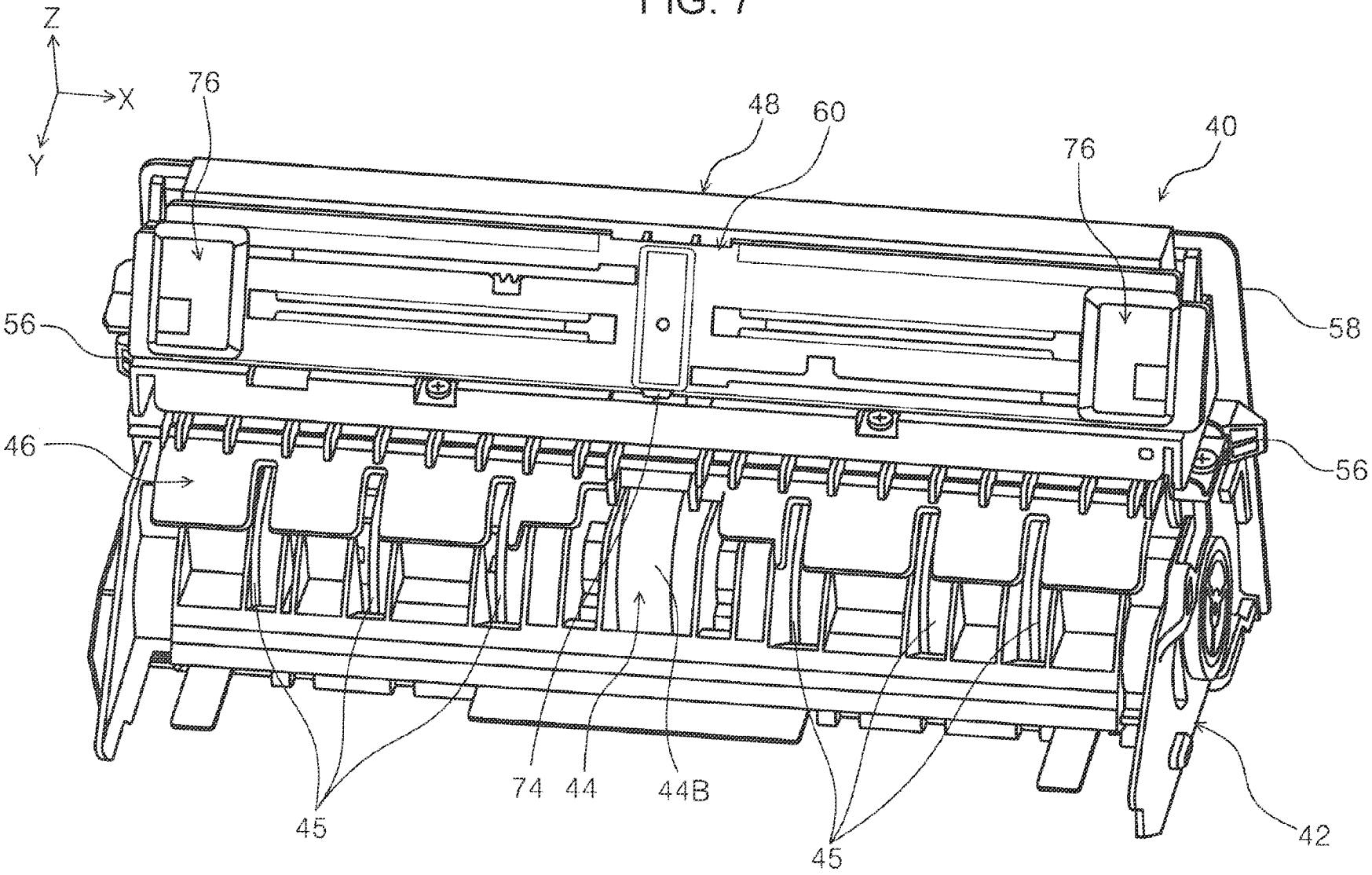
FIG. 7 is a perspective view of an inversion unit to which an extension unit according to the embodiment is attached.

As illustrated in FIG. 7, the inversion unit 40 is configured to include a body member 42, the inverting roller 44, auxiliary disks 45, an upper guide member 46, a pedestal member 48, the rear surface cover 58, and movable claw portions 56. Further, FIG. 7 illustrates a state in which the extension unit 60 is attached to the pedestal member 48.

The body member 42 is formed in a prismatic shape whose axial direction is the X-axis direction. In addition, the body member 42 is formed in a trapezoidal shape when viewed from the X-axis direction. A +Y side portion of the body member 42 is inclined toward the front lower side (+Y side and −Z side), and a plurality of through holes are formed therein. A −Y side portion of the body member 42 stands upright in the Z direction.

The inverting roller 44 has a shaft portion 44A (FIG. 2) that extends in the X axis direction and a rotary portion 44B that is cylindrical and formed in the center portion of the shaft portion 44A in the X-axis direction. The outer peripheral surface of the inverting roller 44 faces the first path K1 and the inverting path K5 (FIG. 2) when viewed in the X-axis direction with the inversion unit 40 attached to the body portion 12 (FIG. 2). In addition, the inverting roller 44 is driven to rotate by a motor (not illustrated) and inverts the front and back surfaces of the paper sheet P.

The auxiliary disks 45, with the X-axis direction as the axial direction, are disposed on the +X side and the −X side of the rotary portion 44B with a space therebetween, and are integrated with the shaft portion 44A.

The upper guide member 46 is disposed so as to face the +Z side and +Y side portions of the body member 42, and forms a portion of the first path K1 (FIG. 2) together with the body member 42.

The rear surface cover 58 is formed in a plate shape having the Y-axis direction as the thickness direction, and is attached to the −Y side portion of the body member 42. In addition, the rear surface cover 58 is formed with window portions 58A (upper diagram in FIG. 4) that penetrate in the Y-axis direction.

The movable claw portions 56 are provided in the body member 42 so as to be relatively movable in the X-axis direction, and are urged outward in the X-axis direction by springs (not illustrated). In addition, the movable claw portions 56 are configured to move toward the center in the X-axis direction by being operated through the window portions 58A. In addition, the movable claw portions 56 restrict the movement of the inversion unit 40 with respect to the body portion 12 when engaged with recessed portions (not illustrated) formed in the body portion 12.

Figure 8:
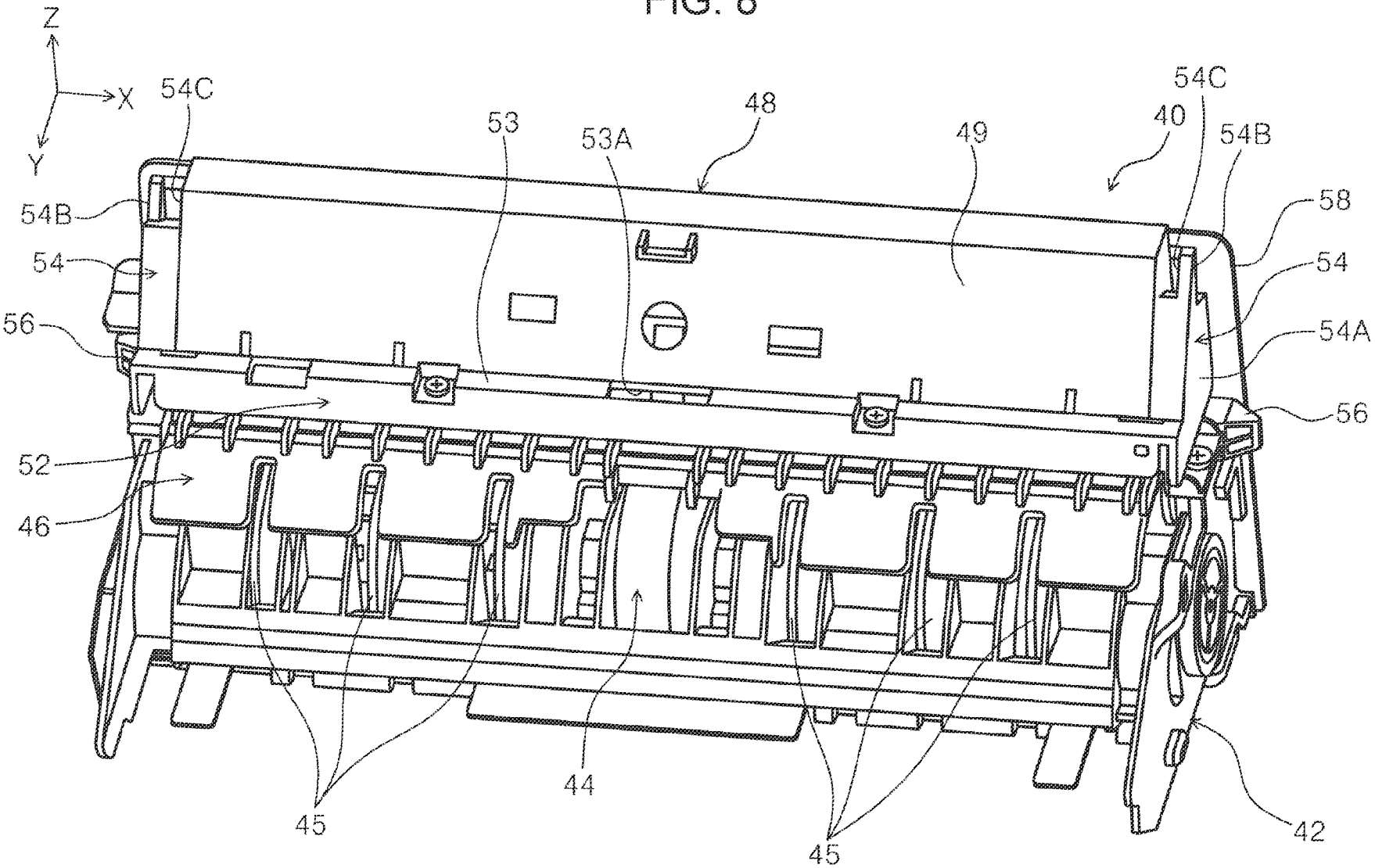
FIG. 8 is a perspective view of the inversion unit with the extension unit according to the embodiment detached therefrom.

The pedestal member 48 illustrated in FIG. 8 is an example of a pedestal portion, and is formed as a member long in the X-axis direction. Further, FIG. 8 illustrates a state in which the extension unit 60 (FIG. 7) has been detached from the pedestal member 48. An inclined surface 49 is formed on the +Y side of the pedestal member 48. The inclined surface 49 is inclined downward toward the front side so that the +Y side portion is located on the −Z side with respect to the −Y side portion. In other words, the inclined surface 49 extends in an intersecting direction that intersects the mounting direction of the inversion unit 40 toward the body portion 12 (FIG. 1). The inclination angle of the inclined surface 49 with respect to the Y-axis direction is, for example, about 50°.

At a +Y side end portion of the pedestal member 48, there is formed a bottom portion 52 that protrudes in a plate shape from the inclined surface 49 toward the +Y side. The bottom portion 52 has an upper surface 53 that is a +Z side surface. A through hole 53A is formed in the center of the upper surface 53 in the X-axis direction. The inclined surface 49 and the upper surface 53 support the extension unit 60 when the extension unit 60 (FIG. 7) is attached to the pedestal member 48.

In addition, in the pedestal member 48, side portions 54 are formed on the +X side and the −X side of the inclined surface 49. Each of the side portions 54 has a side wall 54A along the YZ plane and a flange 54B. A through hole 54C is formed in the flange 54B.

Figure 9:
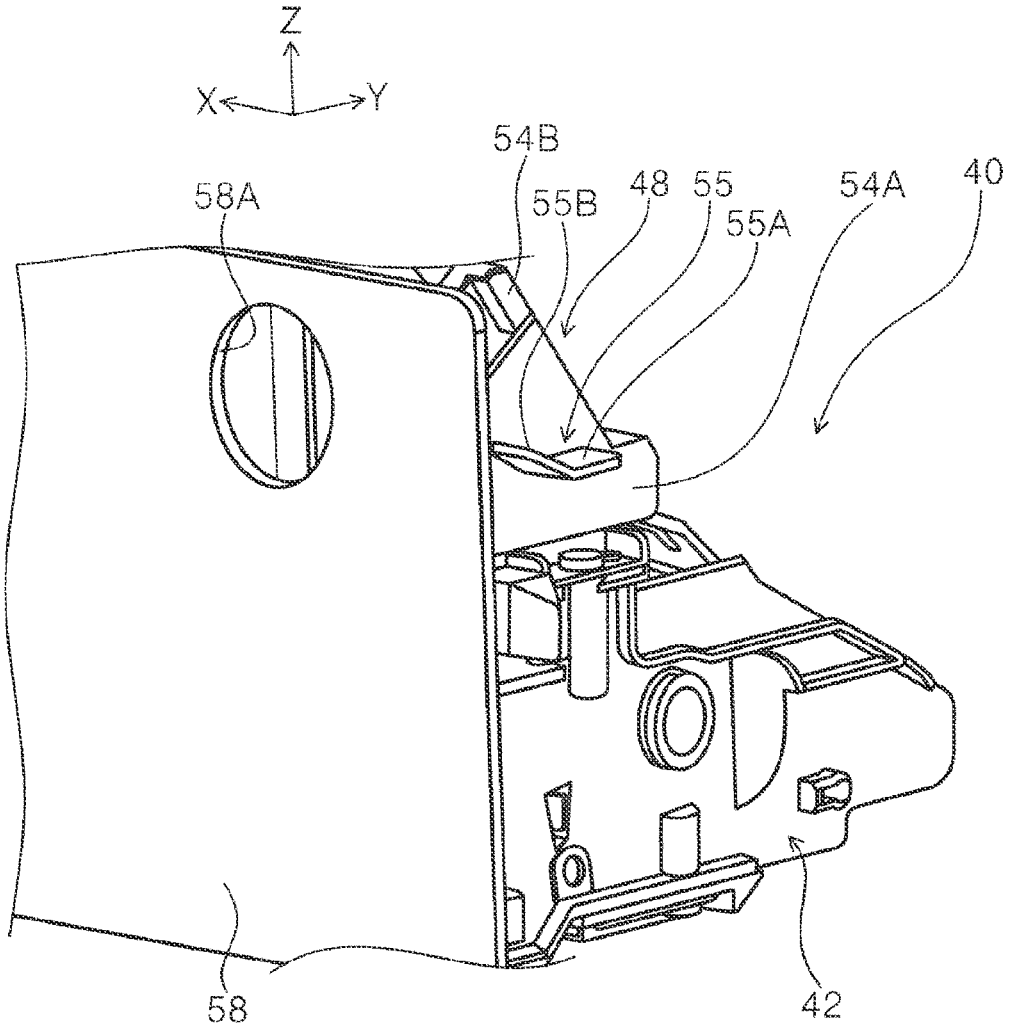
FIG. 9 is a perspective view of a side portion of the inversion unit according to the embodiment.

As illustrated in FIG. 9, a to-be-detected portion 55 is formed on the side wall 54A on the −X side. The to-be-detected portion 55 protrudes from the side wall 54A toward the −X side. In addition, the to-be-detected portion 55 has, for example, a planar portion 55A extending in the Y-axis direction and an inclined portion 55B extending obliquely from a −Y side end portion of the planar portion 55A. The planar portion 55A is disposed between the emitting portion 26A and the light receiving portion 26B (FIG. 6) when the inversion unit 40 is mounted on the body portion 12 (FIG. 1), and blocks the light.

Extension Unit

Figure 10:
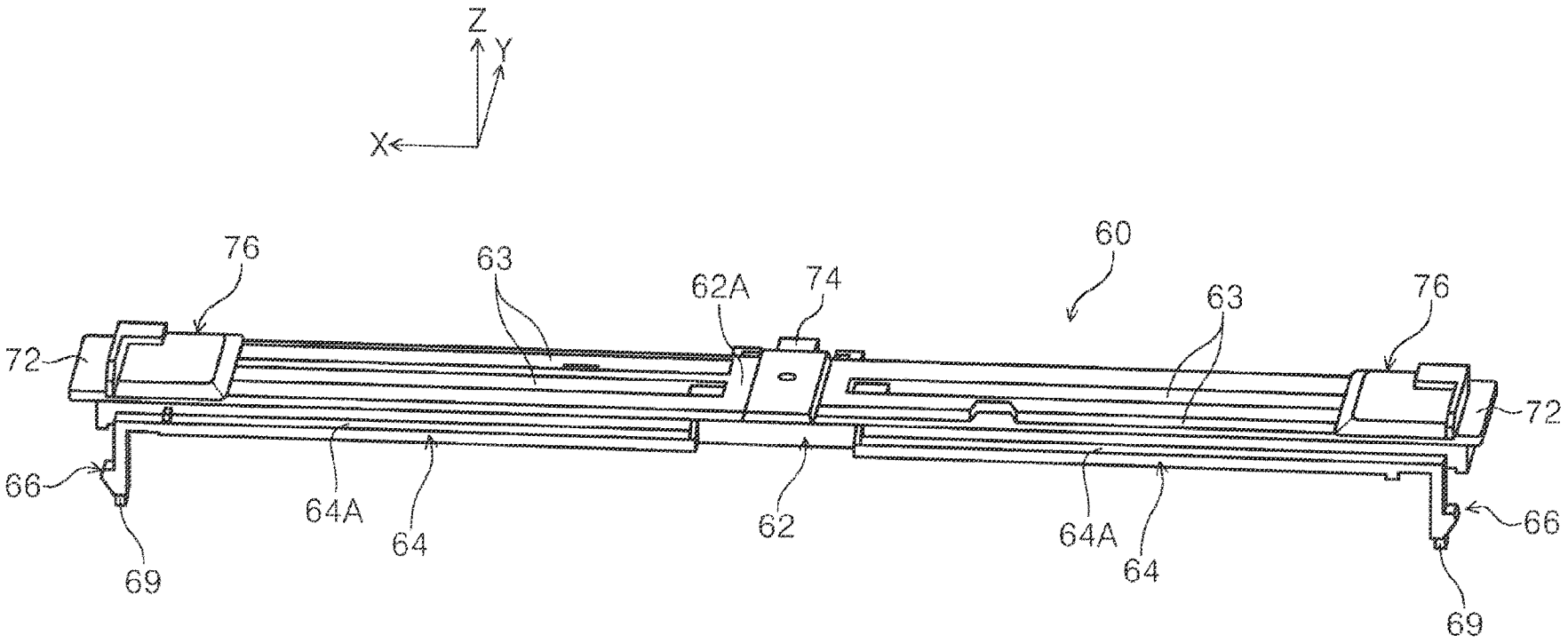
FIG. 10 is a perspective view of the extension unit according to the embodiment.

The extension unit 60 illustrated in FIG. 10 is provided so as to be attachable to and detachable from the pedestal member 48 (FIG. 8) of the inversion unit 40. Specifically, the extension unit 60 includes, for example, the base portion 62, overhanging portions 64, engagement portions 66, knob portions 69, grip portions 72, a protruding portion 74, and edge guides 76. In the extension unit 60, portions other than the edge guides 76 are, for example, integrally formed.

Further, the base portion 62, the overhanging portions 64, the engagement portions 66, the knob portions 69, and the grip portions 72 are, for example, formed symmetrically on the +X side and the −X side with respect to the center in the X-axis direction. For this reason, in the following description, the +X side portion of the extension unit 60 will be basically described, and the −X side portion may be omitted.

The base portion 62 is a plate-shaped portion having a thickness direction in the Z-axis direction. In addition, the base portion 62 is formed in a rectangular shape that is long in the X-axis direction and short in the Y-axis direction when viewed from the Z-axis direction. Slits 63 that are elongated in the X-axis direction are formed in a portion of the base portion 62.

The overhanging portion 64 extends from a −Y side end portion of the base portion 62 toward the −Y side in the form of a plate that is long in the X-axis direction. The X-axis direction length and the Y-axis direction length of the overhanging portion 64 are shorter than the X-axis direction length and the Y-axis direction length of the base portion 62. In addition, an upper surface 64A of the overhanging portion 64 is disposed at a height position on the −Z side with respect to the height position of an upper surface 62A of the base portion 62.

Figure 11:
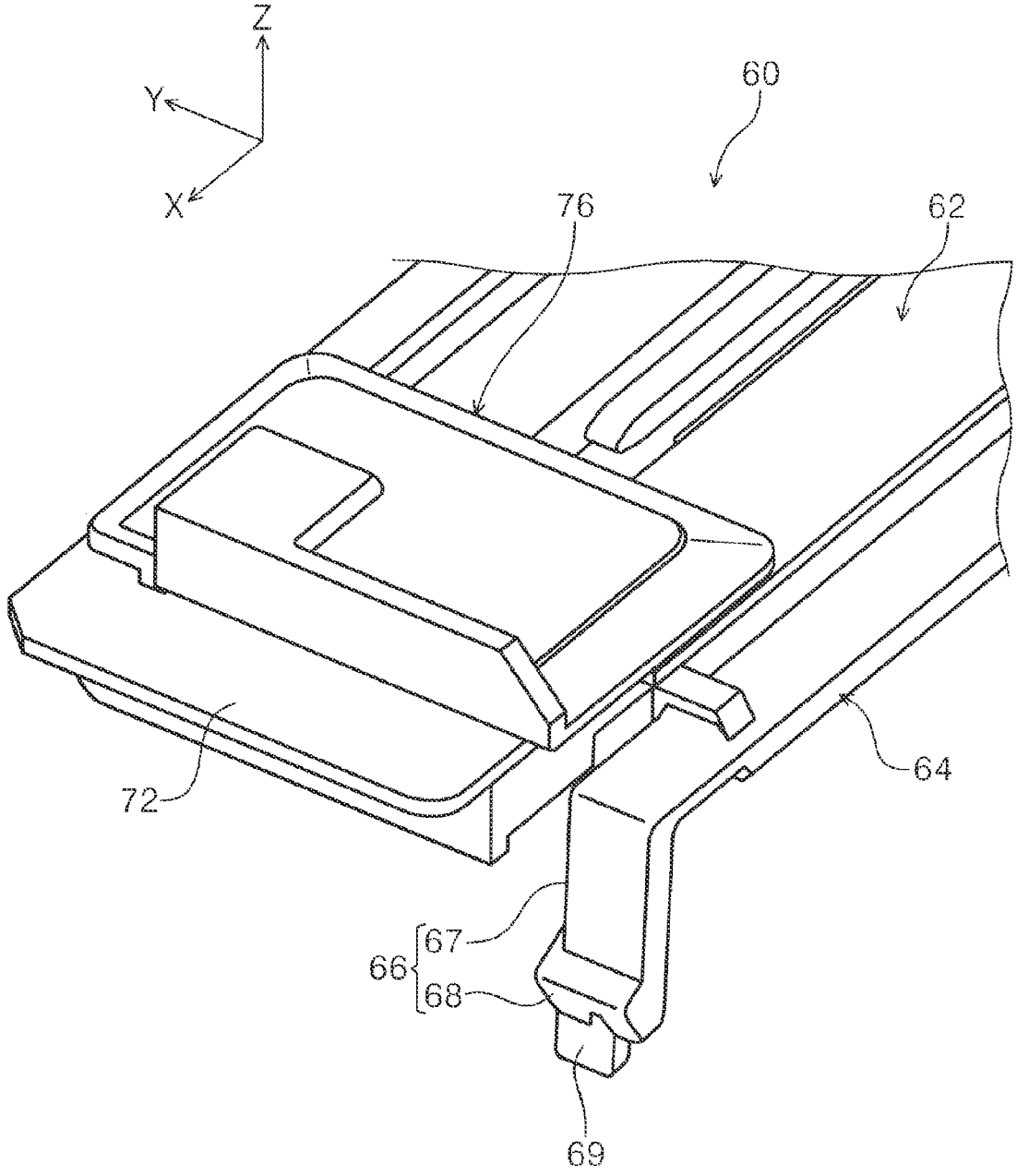
FIG. 11 is a perspective view of an end member of the extension unit according to the embodiment.

As illustrated in FIG. 11, the engagement portion 66 has, for example, an arm portion 67 and a claw portion 68. The arm portion 67 extends from a +X side end portion of the overhanging portion 64 toward the −Z side in a plate shape having the thickness direction in the X axis direction. In addition, the arm portion 67 is elastically deformable in the X-axis direction.

The claw portion 68 protrudes toward the +X side from a −Z side end portion of the arm portion 67. In addition, the claw portion 68, when viewed from the Y axis direction, is formed in an inverted triangular shape. The size of the claw portion 68 is set to a size capable of engaging with the edge portion of the -engaged portion 33 and the through hole 54C (FIG. 8) described above.

The knob portion 69 extends from the −Z side end portion of the arm portion 67 further toward the −Z side in a plate shape with the X axis direction as the thickness direction. The arm portion 67 is elastically deformed by moving the knob portion 69 to the +X side or the −X side while the knob portion 69 is being held by the user.

The grip portion 72 protrudes in a plate shape from a portion that is the +X side end portion and a +Z side end portion of the base portion 62 to the +X side with the Z axis direction as the thickness direction. The grip portions 72 are gripped by the user when the extension unit 60 is to be attached to or detached from the body portion 12 or the inversion unit 40 (FIG. 1).

As illustrated in FIG. 10, the protruding portion 74 protrudes toward the +Y side from the +Y side end portion at the center of the base portion 62 in the X-axis direction. In addition, the protruding portion 74 is formed in a plate shape having the Z-axis direction as the thickness direction. The shape and size of the protruding portion 74 are such that the protruding portion 74 can be inserted into the cutout portion 29 (FIG. 13) and the through hole 53A (FIG. 8) described above. By abutting the protruding portion 74 against the inner wall surface of the cutout portion 29, movement of the extension unit 60 toward the +X side or the −X side and movement toward the +Y side are restricted.

The edge guides 76 are an example of guide portions, and one is provided on each of the +X side and the −X side. The pair of edge guides 76 are coupled to a known rack and pinion mechanism through the slits 63, and one of the edge guides 76 can move following the other. Then, the pair of the edge guides 76 guide, in the Y-axis direction, both end portions of the sheet material S (lower diagram of FIG. 14) in the X-axis-direction. In this way, the extension unit 60 has a function of guiding, in the transport direction, the end portions of the sheet material S in the width direction intersecting the transport direction.

Description of Operation and Effect of Embodiment

In the printer 10 illustrated in FIG. 2, when the inversion unit 40 is detached from the body portion 12, the support members 15A, 15B and 15C are pulled out to the +Z side.

As a result, as illustrated in the upper diagram of FIG. 4, the −Y side portion of the inversion unit 40 is exposed. Then, by operating the movable claw portions 56 (FIG. 7) described above via the window portions 58A, the inversion unit 40 is detached from the body portion 12 toward the −Y side.

As illustrated in the lower diagram of FIG. 4, since the inversion unit 40 has been detached, the second manual feed path K4 is exposed.

Here, as illustrated in FIG. 3, the sensor 26 detects that the inversion unit 40 (the upper drawing of FIG. 4) has been detached. In this case, the control unit 28 operates the mobile unit 24 to move the head 22 toward the +Z side. As a result, since the head 22 is retracted to the +Z side, the sheet material S can be transported to the area facing the head 22.

Figure 12:
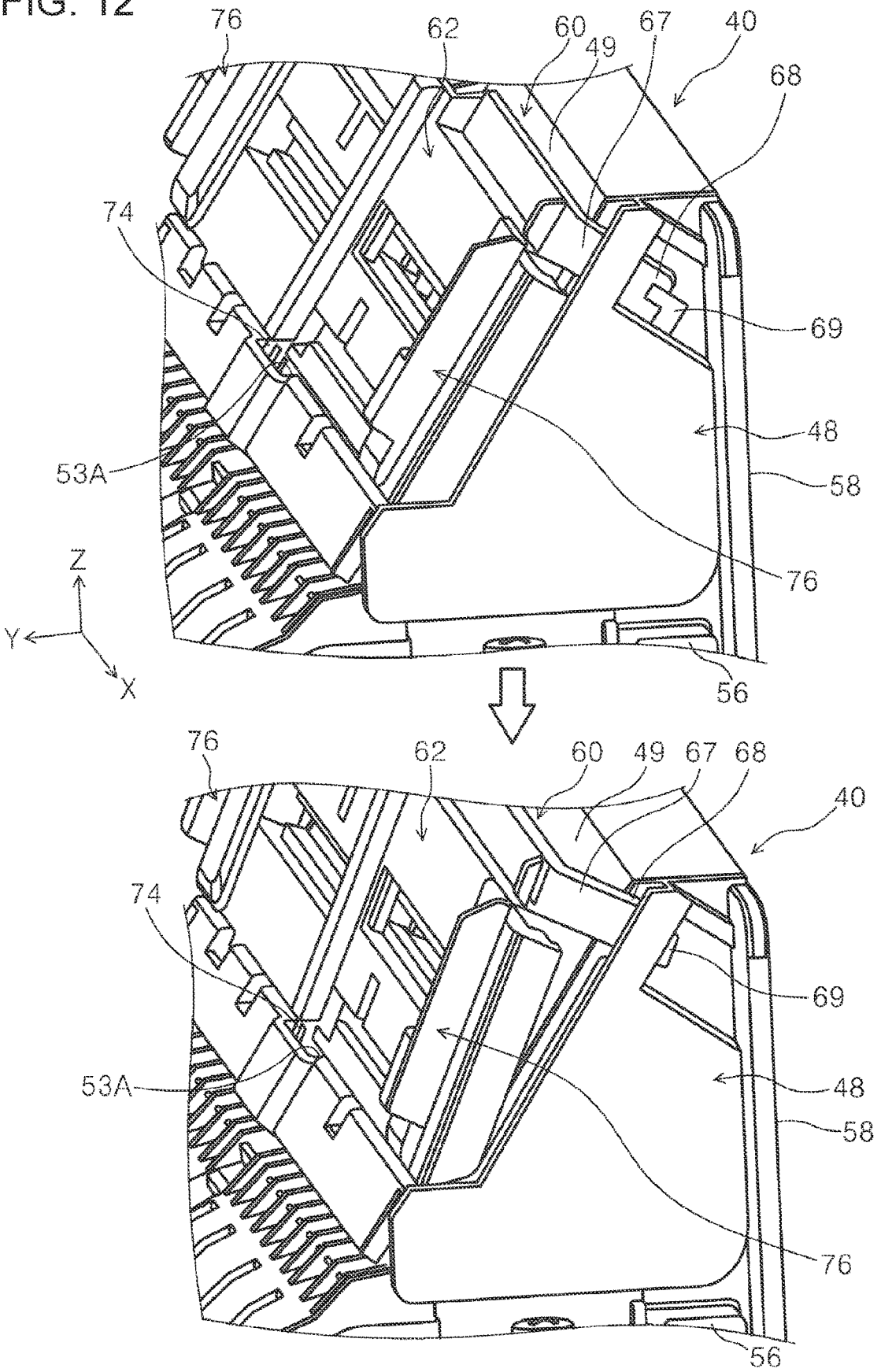
FIG. 12 is a perspective view illustrating a state in which the extension unit is detached from the inversion unit according to the embodiment.

As illustrated in the upper diagram of FIG. 12, the extension unit 60 is attached to the inversion unit 40, which has been detached. Specifically, with the base portion 62 in contact with the inclined surface 49, the extension unit 60 is attached to the pedestal member 48 by inserting the protruding portion 74 into the through hole 53A and engaging the claw portions 68 with the edge portions of the through holes 54C (FIG. 8). In this way, since the extension unit 60 is attached to the inversion unit 40, the user can easily notice the extension unit 60 when the inversion unit 40 is detached from the body portion 12 (FIG. 1). Furthermore, since it is easy to prepare the extension unit 60, the user's work can be prevented from becoming complicated.

Here, as illustrated in the lower diagram of FIG. 12, by moving the knob portion 69 toward the center side in the X-axis direction, the arm portion 67 is elastically deformed, and the engagement between the claw portion 68 and the edge of the through hole 54C (FIG. 8) is released. Then, the extension unit 60 is detached from the pedestal member 48 by lifting the extension unit 60 toward the +Z side.

Figure 13:
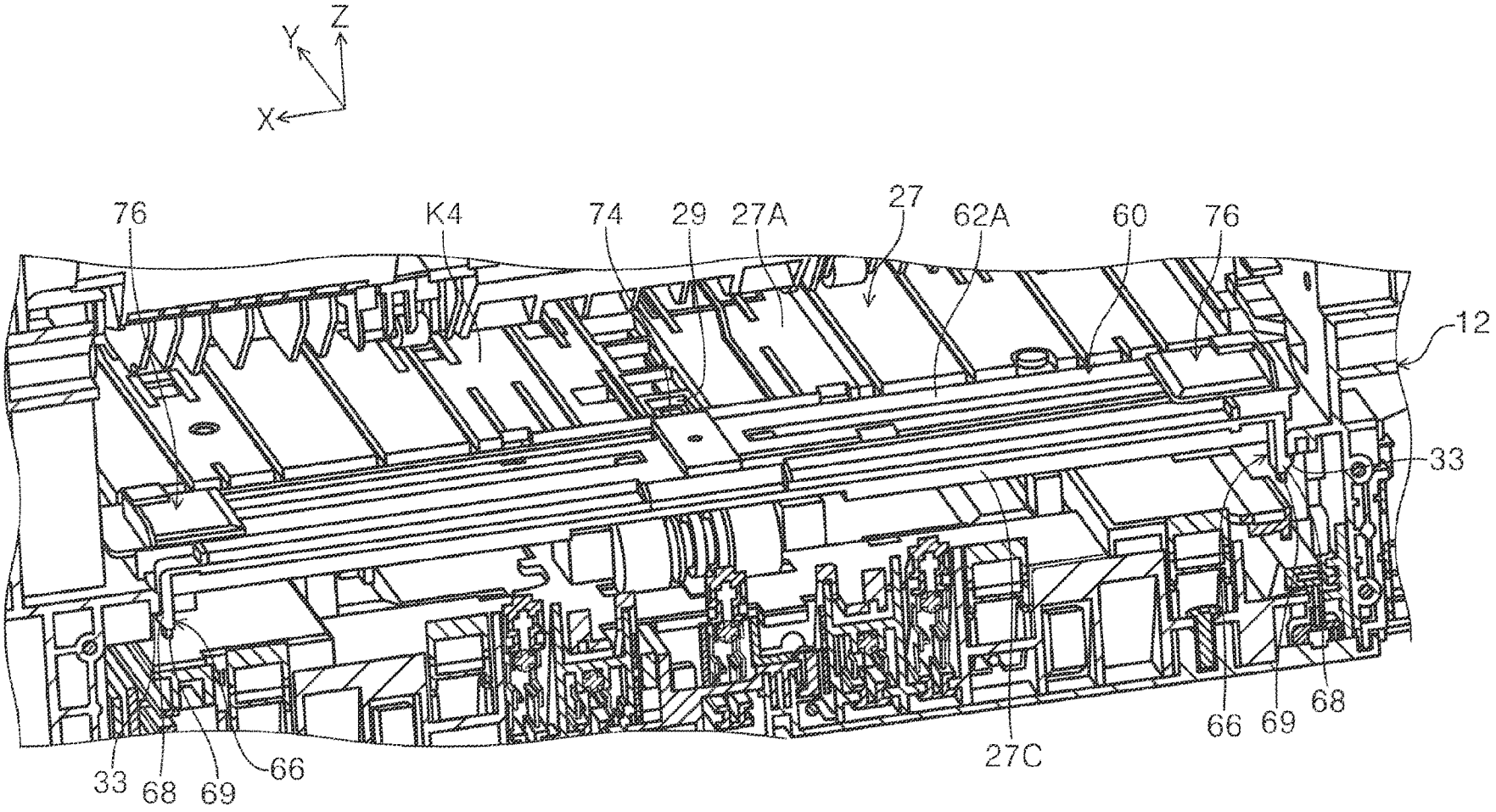
FIG. 13 is a perspective view illustrating a state in which the extension unit is attached to a portion of the transport path of the printer according to the embodiment.

As illustrated in FIG. 13, the extension unit 60 is attached to the body portion 12 by inserting the protruding portion 74 into the cutout portion 29 and engaging the claw portions 68 of the engagement portions 66 with the engaged portions 33. When the extension unit 60 is attached to the body portion 12, the height of the upper surface of the upper wall portion 27A and the height of the upper surface 62A of the base portion 62 are substantially the same.

In this way, in a state in which the inversion unit 40 (FIG. 7) has been detached from the body portion 12, by detaching the extension unit 60 from the inversion unit 40 and attaching the inversion unit 40 to the body portion 12, the second manual feed path K4 is extended in the transport direction of the sheet material S.

As illustrated in the upper diagram of FIG. 14, when the extension unit 60 (FIG. 10) is not attached to the body portion 12, the length of the second manual feed path K4 in the Y-axis direction is short.

On the other hand, as illustrated in the lower diagram of FIG. 14, in a state in which the extension unit 60 is attached to the body portion 12, since the length of the second manual feed path K4 in the Y-axis direction becomes long and the portion on which the transported sheet material S is supported becomes long, the transport state of the sheet material S becomes stable.

Next, a procedure for housing the extension unit 60 in the body portion 12 will be described.

In the state in which the extension unit 60 is attached to the body portion 12 illustrated in FIG. 13, the extension unit 60 is detached from the body portion 12 by operating the knob portions 69 to release the engagement state between the engagement portions 66 and the engaged portions 33.

As illustrated in the upper diagram of FIG. 12, the extension unit 60 is attached to the pedestal member 48 by engaging the claw portions 68 with the peripheral portion of the through holes 54C (FIG. 8). The inversion unit 40 to which the extension unit 60 has been attached is mounted on the body portion 12 by engaging the movable claw portions 56 with recessed portions (not illustrated) of the body portion 12.

As illustrated in FIG. 2, the extension unit 60 is disposed in the space portion E on the −Y side of the first manual feed path K3 and on the +Z side of the inverting roller 44. Here, since the space portion E is originally a space portion (dead space) that is not used, it is possible to prevent an increase in the size of the body portion 12 even if the extension unit 60 is housed therein.

(1) As described above, according to the present embodiment, the inversion unit 40 is attached to and detached from the body portion 12 with the extension unit 60 attached to the inversion unit 40. Since the extension unit 60 is used as a portion of the inversion unit 40 that is attached to and detached from the body portion 12, it is not necessary to secure a storage space dedicated to the extension unit 60 in the body portion 12, and it is possible to prevent an increase in the size of the body portion 12.

Furthermore, the extension unit 60 is detached from the inversion unit 40 in a state in which the inversion unit 40 is detached from the body portion 12. The extension unit 60 that has been detached from the inversion unit 40 is attached to the body portion 12 to extend the second manual feed path K4 in the sheet material S transport direction. In this way, since the extension unit 60 is attached to the inversion unit 40, and the user does not have to search for the extension unit 60, the user can easily attach the extension unit 60 to the body portion 12.

That is, according to this aspect, in the configuration in which the inversion unit 40 is attached to and detached from the body portion 12 having the second manual feed path K4, it is possible to improve the workability of the user in extending the second manual feed path K4 and suppress an increase in the size of the body portion 12 at the same time.

(2) According to the present embodiment, since the inversion unit 40, which has a longer path length than that in the case of transporting only the front surface or the back surface, is attachable to and detachable from the body portion 12, when the transport of the paper sheet P is stopped in the inversion unit 40, the paper sheet P can be easily removed from the first manual feed path K3 and the like.

(3) According to the present embodiment, since a portion of the inverting path K5 also serves as a portion of the second bypass path K4, and since the space required for the arrangement of the second manual bypass path K4 and the inverting path K5 is reduced compared with a configuration where these exist separately, the paper sheet transport portion 30 can be reduced in size.

(4) According to the present embodiment, when the extension unit 60 is attached to the body portion 12, by pressing the engagement portions 66 toward the engaged portions 33, the engagement portions 66 are engaged with the engaged portions 33 while being elastically deformed. In this way, the attachment of the extension unit 60 can be easily performed by attaching the extension unit 60 to the body portion 12 by pressing the extension unit 60 in one direction.

(5) According to the present embodiment, when the sheet material S is transported in the second manual feed path K4 extended by the extension unit 60, the sheet material S is guided in the Y-axis direction, which is the guide direction, by the edge guide 76 against which the end portions of the sheet material S in the width direction abut. As a result, it is possible to prevent the sheet material S that enters the second manual feed path K4 from the extension unit 60 from skewing to the +X side or the −X side of the transport direction.

(6) According to the present embodiment, when the inversion unit 40 is mounted on the body portion 12, an external force acts on the inversion unit 40 in the Y-axis direction, which is the mounting direction. Here, when the extension unit 60 is pressed in the Y-axis direction by the action of the external force, since the extension unit 60 is in contact with the inclined surface 49 and disposed in an inclined manner, the external force in the Y-axis direction is less likely to become concentrated on a portion of the extension unit 60 as compared with a configuration in which the extension unit 60 stands upright in the Z-axis direction. Consequently, deformation of the extension unit 60 can be suppressed.

(7) According to this embodiment, when the inversion unit 40 is detached from the body portion 12, the sensor 26 detects the detachment. In this case, the control unit 28 controls the mobile unit 24 to move the head 22 to a side where the head 22 is retracted from the second path K2. As a result, the head 22 retracts from the second path K2. In this way, since the distance between the head 22 and the second path K2 becomes longer in accordance with the detachment of the inversion unit 40, in the second path K2, the sheet material S, which is thicker than the paper sheet P, can be transported, and the sheet material S can be processed by the head 22.

Other Embodiments

The paper sheet transport portion 30 and the printer 10 according to the embodiment of the present disclosure are basically based on having the above-described configurations; however, it is of course possible to partially change or omit a configuration without departing from the scope of the present disclosure.

The printer 10 is not limited to the ink jet type, but may be of an electrophotographic type. The medium is not limited to the paper sheet P or the sheet material S, and may be a sheet-shaped film.

The processing apparatus is not limited to a recording apparatus such as the printer 10, but may be, for example, a scanner (information reading apparatus) in which the head 22 is replaced with an image reading portion.

The unit that is attached to and detached from the body portion 12 in the paper sheet transport portion 30 is not limited to the inversion unit 40 forming the inverting path K5, and, for example, may be a unit that forms a portion of the first path K1 and exposes the second manual feed path K4.

In addition, although not illustrated, the unit that is attached to and detached from the body portion 12 may be a unit that forms a second housing portion provided above the housing portion 14. For example, the second housing portion may be a portion such as a sheet feeding cassette that is mostly pulled out from the apparatus body and partially remains in the apparatus body. In this way, at least a portion of the attachment/detachment portion may be separated from the apparatus body.

A portion of the inverting path K5 need not also serve as a portion of the second manual feed path K4.

The extension unit 60 may be one in which the portion attached to the body portion 12 does not elastically deform. For example, a portion of the extension unit 60 to be attached to the body portion 12 may be formed of a metal pin, and the pin may be inserted into the hole of the body portion 12 to be engaged with the body portion 12.

In the paper sheet transport portion 30, the extension unit 60 need not have the edge guides 76. In addition, the edge guides 76 are not limited to the movable type, and may be formed integrally with the base portion 62.

The pedestal member 48 is not limited to one having the inclined surface 49, and the extension unit 60 may be attached to the upper surface along the XY plane or the side surface along the XZ plane.

The printer 10 is not limited to one in which the head 22 moves in the Z-axis direction, and may have the guide member 41 in the Z-axis direction. In addition, the medium support portion 15 may be a separate body, and the rear surface cover 58 of the inversion unit 40 may form the −Y side surface of the printer 10.

What is claimed is:

1. A medium transport apparatus comprising:

an apparatus body having a transport path for a medium;

an attachment/detachment portion that is configured to be mounted on the apparatus body and at least a portion of which is configured to be separated from the apparatus body, that covers the transport path when the attachment/detachment portion is mounted on the apparatus body, and that exposes a portion of the transport path when at least the portion of the attachment/detachment portion is separated from the apparatus body; and a path extension member configured to be attached to and detached from the attachment/detachment portion, wherein the path extension member extends, in a state in which the attachment/detachment portion is separated, the transport path in a transport direction of the medium by being detached from the attachment/detachment portion and attached to the apparatus body.

2. The medium transport apparatus according to claim 1, wherein the attachment/detachment portion is an inversion portion that inverts the medium between a front surface and a back surface.

3. The medium transport apparatus according to claim 2, wherein a portion of an inverting path formed by the inversion portion being mounted on the apparatus body also serves as a portion of the transport path.

4. The medium transport apparatus according to claim 1, wherein a engaged portion is formed on the apparatus body, and the path extension member has an engagement portion that engages with the engaged portion while the engagement portion is being elastically deformed.

5. The medium transport apparatus according to claim 1, wherein the path extension member has a guide portion that guides, in the transport direction, an end portion of the medium in a width direction intersecting the transport direction.

6. The medium transport apparatus according to claim 1, wherein the attachment/detachment portion has a pedestal portion in which an inclined surface is formed so as to extend in an intersecting direction that intersects a mounting direction toward the apparatus body, and the path extension member is configured to be attached, in contact with the inclined surface, to the pedestal portion and to be detached from the pedestal portion.

7. A processing apparatus comprising:

the medium transport apparatus according to claim 1; and a processing portion that performs processing on the medium being transported on the transport path.

8. The processing apparatus according to claim 7, further comprising:

a mobile portion that moves the processing portion in an intersecting direction that intersects the transport direction;

a detection portion that detects separation of the attachment/detachment portion from the apparatus body; and a control portion that controls, when the detection portion detects separation of the attachment/detachment portion, the mobile portion to move the processing portion to a side where the processing portion is retracted from the transport path.

9. The medium processing apparatus according to claim 7, wherein the processing portion is a recording portion that records information on the medium based on received information.

* * * * *